US005101705A

United States Patent [19]

Matsuoka

[11] Patent Number: 5,101,705

[45] Date of Patent: Apr. 7, 1992

[54] DIE INCLUDING SLIDE CAM

[75] Inventor: Mitsuo Matsuoka, Osaka, Japan

[73] Assignee: Umix Co., Ltd., Osaka, Japan

[21] Appl. No.: 631,150

[22] Filed: Dec. 20, 1990

[51] Int. Cl.[5] ..... B26D 5/16

[52] U.S. Cl. ..... 83/588; 72/452; 83/620; 83/627; 83/635

[58] Field of Search ..... 83/635, 624, 627, 620, 83/588; 100/291; 72/452

[56] References Cited

U.S. PATENT DOCUMENTS

| | | | |
|---|---|---|---|
| 2,421,864 | 6/1947 | Becker | 83/627 X |
| 2,539,085 | 1/1951 | Kerseg | 83/627 |
| 3,033,066 | 5/1962 | Coulon | 83/635 X |
| 3,541,909 | 11/1970 | Franzen | 83/635 X |
| 3,709,082 | 1/1973 | Leska | 83/627 X |
| 4,669,345 | 6/1987 | Suinat et al. | 83/627 X |

*Primary Examiner*—Frank T. Yost
*Assistant Examiner*—Kenneth E. Peterson

[57] ABSTRACT

In a die including a cam member, which can be compactly designed in addition to the necessary function given to a cam member, in order to accomplish high quality machining without moving the cam member in a serpentine fashion, the die includes a slide cam having a slide cam base on the top of which a polyhedral guide portion is formed, the slide cam which holds and supports the polyhedral guide portion of the slide cam base being slidable along the polyhedral guide portion, and onto which machining tools such as a punch and a trimming edge are mounted, an elastic body interposed between the slide cam base and the slide cam for urging the slide cam, and a driving cam contacting the slide cam for driving the same.

7 Claims, 4 Drawing Sheets

DIE INCLUDING SLIDE CAM

BACKGROUND OF THE INVENTION

1. Field of the Invention

The present invention relates to a die including a slide cam.

2. Description of Related Art

In the ordinary die, a lower die and an upper die are mounted respectively on a bed and a ram of a pressing machine so that piercing and forming processings can be accomplished by ascending and descending the upper die. Since the upper die is moved up and down, the transverse machining is effected by converting the vertical machining force to a horizontal machining force by using a cam member.

This will be explained by the example of piercing the side wall of the work with the die including the cam member.

As shown in FIG. 5 and FIG. 6, a positioning member 104 which positions the work 103 on a base plate 102 is scured to the lower die 101. At a position opposing a hole 105 to be pierced in the side wall of the work 103, a driven cam 107 including a punch 106 is slidably disposed. A heel 108 is secued to the rear side of the driven cam 107. A coil spring 109 is installed around the top side of the rod 110 which is threaded into the driven cam 107 inserted through the heel 108, and one end of the coil spring 109 is contacted with the heel 108, and a nut 112 is screwed onto the other end of the coil spring 109 via a washer 111 to urge such that the driven cam 107 is drawn back after piercing the work 103. A driving cam 118 is secured to a base plate 117 of the upper die 116 at a position opposing the driven cam 107.

When the upper die 116 is descended, the driving cam 118 moves the driven cam 107 forward against the biasing force of the coil spring 109 to pierce the hole 105 in the work 103 by the punch 106 and a die 125, and when the upper die 116 is ascended, the driven cam 107 is moved rearward by the biasing force of the coil spring 109.

For piercing the side wall of the work 105, as aforementioned, the driven cam 107 inculuding a punch 106 slides on the base plate 102 while approaching to and parting from the work 104. The driving cam 107 has to slide accurately to pierce by the punch 106 and die 125, therefore, flanges 121 are projected on lower opposite sides of the driven cam 107, and side guide plates 122 and upper guide plates 123 for guiding the flanges 121 are fixed to the base plate 102.

In the aforementioned die, in order to allow the driving cam 107 to slide between predetermined positions, the side guide plates 122 for guiding the side faces of the flanges 121 projected on the sides of the driven cam body 107*a*, and the upper guide plates 123 for guiding the upper faces of the flanges 121 are disposed. Since these flanges 121, side guide plates 122 and upper guide plates on 123 are provided, a length l is projected respectively on opposite sides of the body portion 107*a* of the driven cam 107, the length l being usually about 100 to 150 mm at a minimum, whereby a large space is occupied on the base plate 102 of the lower die 101 of the press die.

Accordingly, a large space is occupied when a cam mechanism is provided on the die. Since the large space is occupied by providing the cam mechanism, the die size is restricted by the bed area of the pressing machine and the necessary members may not be installed on the die, therefore, sometimes the machining processes must be increased and the die has to be added.

A wear plate 124 provided on the tip of the flange 121 projected on the side of the body portion 107*a* of the driven cam 107 wears as the driven cam 107 repeats the sliding operations, producing a gap between the side guide plates 122, whereby the driven cam 107 cannot slide linearly and tends to meander by the existence of the gap. The punch 106 installed on the driven cam 107 also moves similarly in a serpentine fashion, thus the punch 106 is unable to punch in the state wherein a proper clearance is maintained circularly around the die 125, producing burrs around the punched hole, thus a high quality punching is impossible. Besides, due to the punching by the punch 106 and die 125 which produce the burrs, edges of the punch 106 and die 125 become damaged.

SUMMARY OF THE INVENTION

Therefore, in view of the aforementioned circumstances, the present invention is directed to a die including a cam member, which can be compactly designed in addition to the necessary function given as the cam member, and in order to accomplish high quality machining without moving the cam member in a serpentine fashion, the die includes a slide cam comprising: a slide cam base on the tip of which a polyhedral guide portion is formed, the slide cam which holds and supports the polyhedral guide portion of the slide cam base and slides along the polyhedral guide portion, and onto which machining tools such as a punch and a trimming edge are mounted; an elastic body interposed between the slide cam base and the slide cam for urging the slide cam, and a driving cam contacted to the slide cam for moving the same.

The slide cam, when the upper die is descended, moves transversely between the driving cam and the slide cam base for pressing works such as piercing and trimming. When the works are completed and the upper die is ascended, the slide cam urged by the elastic body is returned.

Furhter scope of applicability of the present invention will become apparent from the detailed description given hereinafter. However, it should be understood that the detailed description and specific examples, while indicating preferred embodiments of the invention, are given by way of illustration only, since various changes and modifications with the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

The present invention will be particularly described as follows, referring to one specific embodiment shown in FIGS. 1 through 4 of the accompany drawings.

Figure 1:
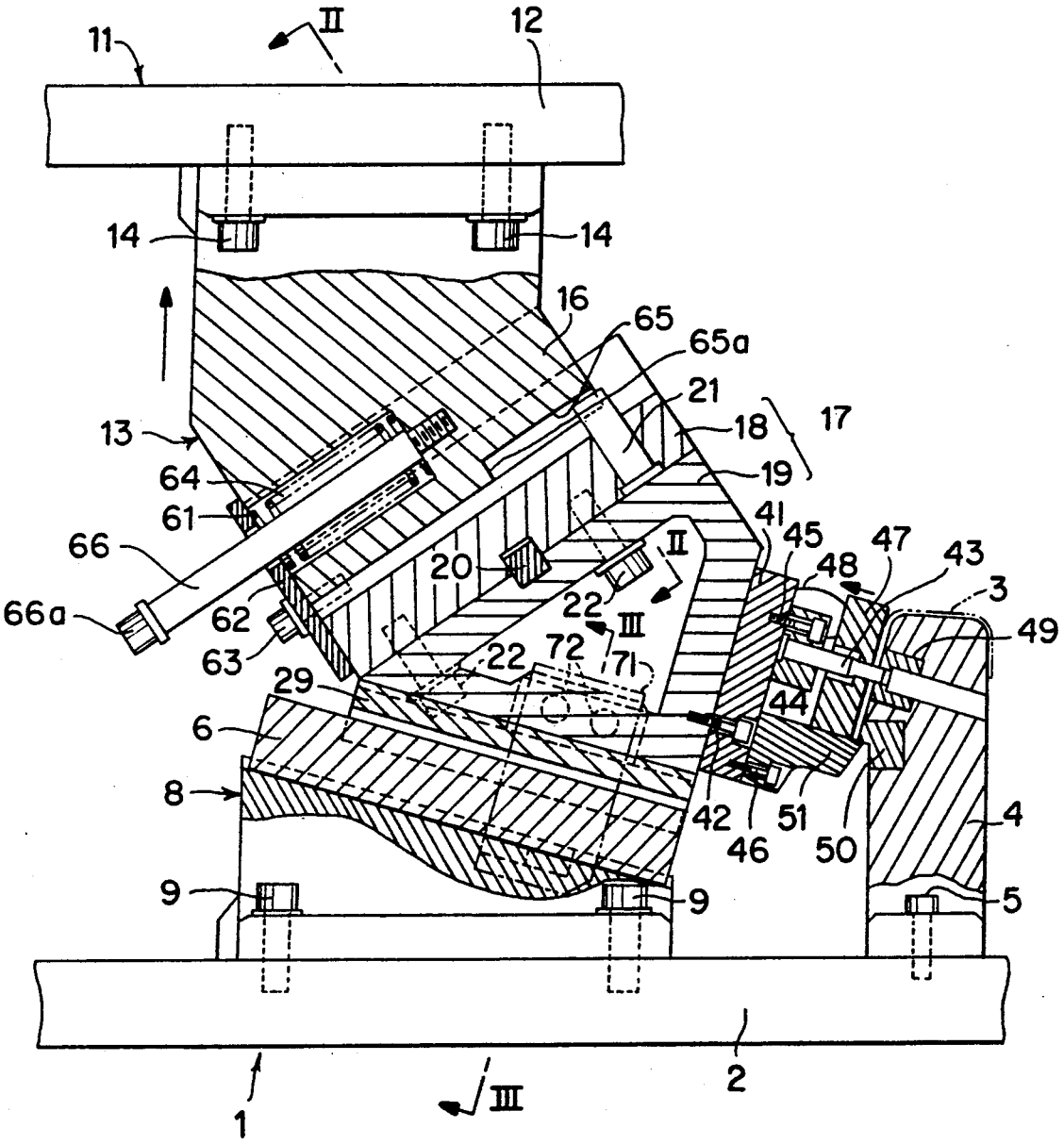
FIG. 1 is a longitudinal sectional view of a die including a slide cam of one specific embodiment of the present invention at a bottom dead point.
Figure 2:
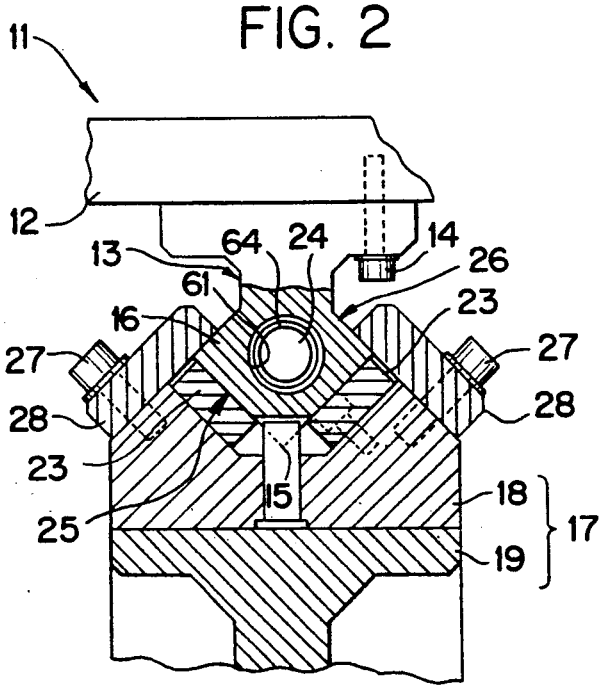
FIG. 2 is a sectional view taken in the direction of the arrows substantially along the line II—II of FIG. 1.
Figure 3:
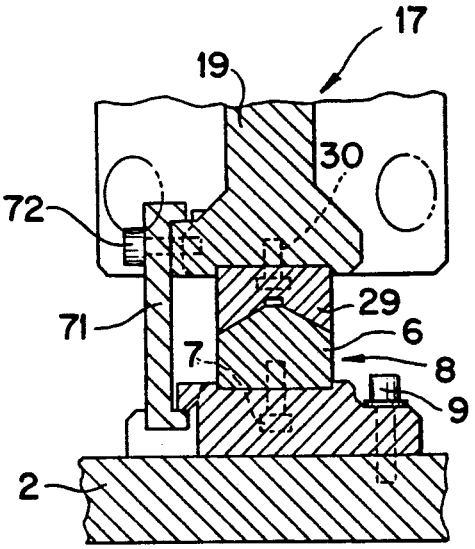
FIG. 3 is a sectional view taken in the direction of the arrows substantially along the line III—III of FIG. 1.
Figure 4:
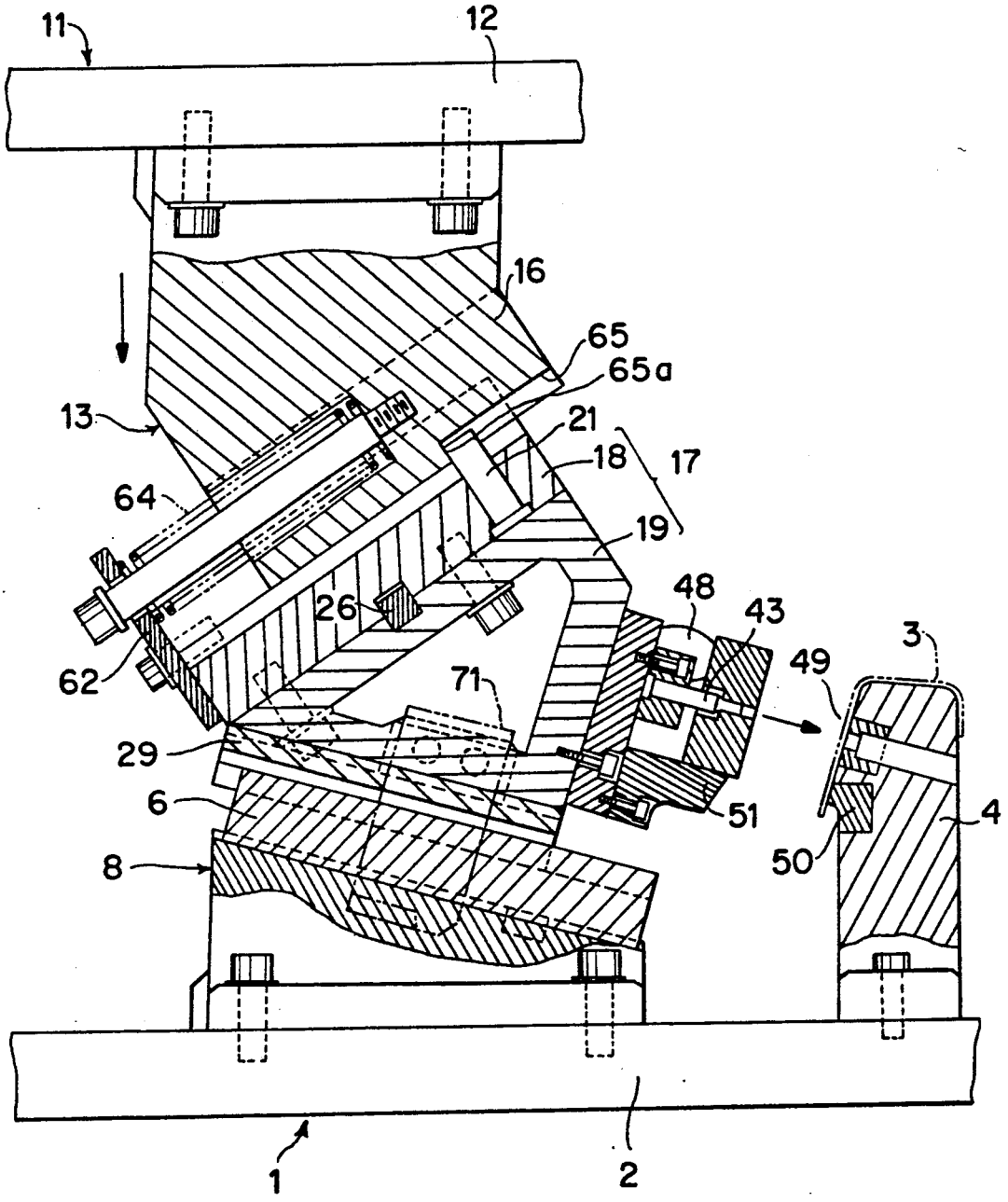
FIG. 4 is a longitudinal sectional view of a cam mechanism of the present invention at a top dead point.
Figure 6:
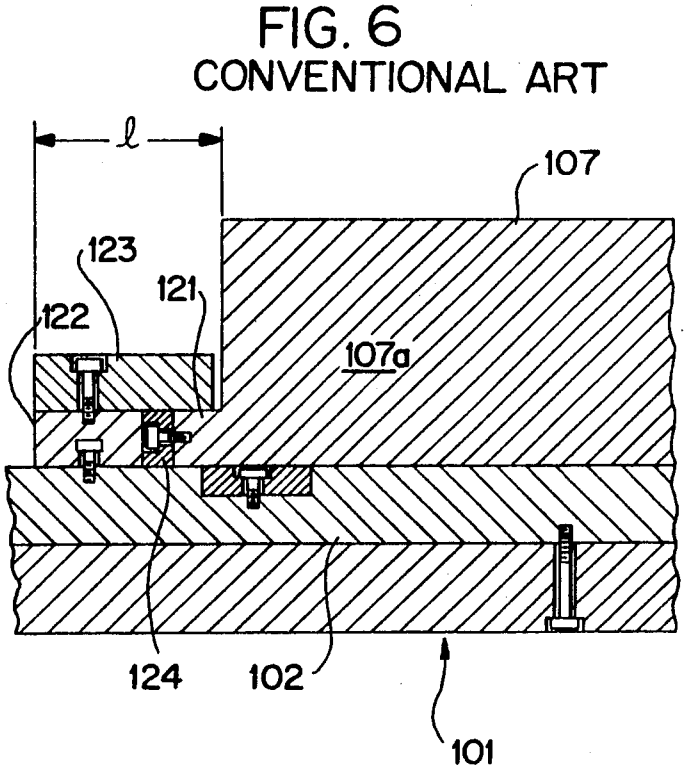
FIG. 6 CONVENTIONAL ART
FIG. 6 is a side view of FIG. 5.
Figure 5:
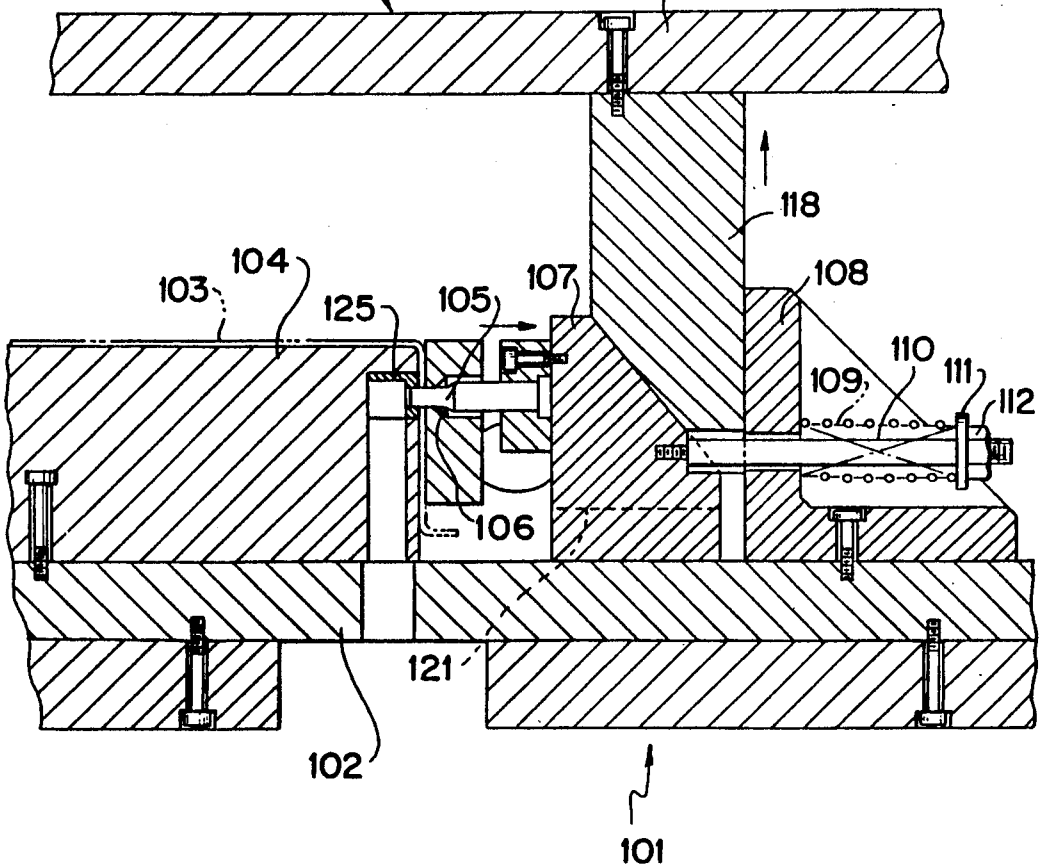
FIG. 5 CONVENTIONAL ART
FIG. 5 is a front view of a press die using a conventional cam mechanism.

FIG. 1 is a longitudinal sectional view of a die including a slide cam of one specific embodiment of the present invention at a bottom dead point, FIG. 2 is a sectional view taken in the direction of the arrows substantially along the line II—II of FIG. 1, FIG. 3 is a sectional view taken in the direction of the arrows substantially along the line III—III of FIG. 1, and FIG. 4 is a longitudinal sectional view of a top dead point.

An example described in the embodiment involves a work pierced and trimmed at its lower end.

On a base plate 2 of a lower die 1, a positioning member 4 which positions the work 3 is fixed by means of bolts 5. In the vicinity of the positioning member 4, a driving cam 8, onto which a guide member 6 whose upper surface is formed into an inclined plane which slants the positioning member 4 so as to contact with a V-shaped groove, is installed with bolts 7, and is fixed by bolts 9.

On a base plate 12 of an upper die 11 opposing the driving cam 8, a slide cam base 13 is secured by bolts 14. The top of the slide cam base 13 is formed into a tetrahedral guide portion 16, which is generally quadrangular in cross section and provided with a crest line 15 at the lower end, and having an inclined plane which, symmetrically with the inclined plane of the driving cam 8, slants upward as approaching the positioning member 4.

A slide cam 17 slidably holds and supports the tetrahedral guide portion 16 of the slide cam base 13, and slides on the guide member 6 of the driving cam 8.

The slide cam 17 comprises a machining member 19 onto which a V-shaped groove member 18, punch and cutting edge are installed. The V-shaped groove member 18 is positioned by a key 20 driven into an opposing face of the machining member 19, and fixed by bolts 22 by raising a stopper 21.

The upper end of the slide cam 17 is formed into a V-shaped groove which has the same inclined plane as that of the tetrahedral guide portion 16 of the slide cam base 13 for receiving the tetrahedral guide portion 16, and is provided with wear plates 23 fixed with bolts 24 to support lower planes 25 of the tetraheral guide portion 16, of the slide cam base 13. Upper planes 26 are urged by biasing plates 28 fixed by bolts 27 to the slide cam 17, which is disposed slidably on the tetrahedral guide portion 16 of the slide cam base 13.

On the lower surface of the slide cam 17, a sliding member 29 which slides on the guide member 6 of the driving cam 8 and having its V-shaped groove in contact therewith is fixed by bolts 30.

On the work machining side of the slide cam 17, a mounting plate 41 is installed by a bolt 42. A punch 43 is installed by fixing a punch plate 44 to the mounting plate 41 by means of a bolt 45. A trimming edge 51 is fixed to the mounting plate 41 by means of a bolt 46. A stripper plate 47 is provided against which a rubber cushion 48 is urged by the work 3 before the work 3 is pierced and trimmed.

The numeral 49 generally indicates a die which is engaged with the punch 43 for piercing, and the numeral 50 denotes a cutting edge which trims the edges of the work 3 in cooperation with the trimming edge 51.

A retaining hole 61 is formed at the rear end portion of the tetrahedral guide portion 16 of the slide cam base 13 for retracting the slide cam 17 after machining, and a support plate 62 is disposed at a position opposing the retaining hole 61 and secured to the slide cam 17 by means of a bolt 63. An elastic body 64 such as a coil spring is provided between the retaining hole 61 and the support plate 62. When the upper die 11 is ascended, the slide cam 17 is retracted by biasing force of the elastic body 64. For the purpose of stopping the retraction of the slide cam 17, the stopper 21 raised on the slide cam 17 is engaged with an end portion 65*a* of a stopping groove 65 formed in the crest line at the lower portion of the tetrahedral guide portion 16 of the slide cam base 13. And, for safety purposes, a safety stopper 66 is screwed into the retaining hole 61 to fix the position of the coil spring, and at the same time, the safety stopper 66 is extended through the support plate 62 and provided with a head portion 66*a* at its end, so as to stop the stopper 21 by the support plate 62 which collides aganist the head portion 66*a*, in case the stopper 21 does not stop at the end portion 65*a* of the stopping groove 65.

Also, for retracting the slide cam 17 forcibly when the upper die 11 is ascended, a return plate 71 is secured to the slide cam 17 with bolts 72, and engaged with the driving cam 8 at the lower end thereof.

Next, the operation of the die will be described.

As shown in FIG. 4, the work 3 is placed on the positioning member 4 and the upper die 11 is descended. FIG. 4 shows a top dead point, where the slide cam 17 disposed slidably on the tetrahedral guide portion 16 of the slide cam base 13 installed on the base plate 12 of the upper die 11, is in contact with the stopper 21.

When the upper die 11 is descended from this state, the sliding member 29 of the slide cam 17 contacts the guide member 6 of the driving cam 8, and the slide cam 17 proceeds toward the work 3 between the driving cam 8 and the slide cam base 13 as the upper die 11 is descended, to pierce the work 3 by the punch 43 and to trim the lower portion of the work 3 with the trimming edge 51.

The state wherein piercing and trimming are effected by the punch 43 and trimming edge 51, and the upper die 11 is at the bottom dead point is shown in FIG. 1.

Thereafter, when the upper die 11 is ascended, the urging force of the elastic body 64 is transmitted to the slide cam 17 from the support plate 62 to retract the slide cam 17, which is prevented by its stopper 21 from contacting the end portion 65*a* of the stopping groove 65.

Since the return plate 71 is provided on the slide cam 17, when the slide cam 17 fails to retract, the return plate 71 is engaged with the driving cam 8 to forcibly retract the slide cam 17.

In the aforementioned embodiment, though the example in which the slide cam base 13, slide cam 17 and driving cam 8 are arranged in order from top to bottom is described, they may be arranged in order of the driving cam 8, slide cam 17 and slide cam base 13 from top to bottom.

That is, a unit comprising the slide cam base 13, slide cam 17 and the driving cam 8 may be used reversely.

Furthermore, though the example of piercing and trimming was described in the embodiment, it is to be understood that the present invention may by applied to other forming and bending processings.

Besides, when size of the slide cam base 13, slide cam 17 and driving cam 8 are standardized, machining of works having various sizes can be performed immediately.

As described heretofore, since the present invention is directed to a die including a slide cam compressing: a slide cam base on the top of which a polyhedral guide portion is formed; the slide cam which holds and supports the polyhedral guide portion of the slide cam base and slides along the polyhedral guide portion, and onto which machining tools such as a punch and a trimming edge are mounted; an elastic body interposed between the slide cam base and the slide cam for urging the slide cam; and a driving cam contacted to the slide cam for driving the same, a cam mechanism can be constituted without disposing cam guiding flanges, side guide plates and upper guide plates, and the cam mechanism can be provided on the die in a minimum amount of space.

Since a large space is occupied by the conventional cam mechanism, the size of die is restricted by the bed area of the pressing machine, so that the necessary members cannot be provided on the die, thus the machining processes must be increased and the die has to be added, but in the present invention, for reasons aforementioned, it is not necessary to add the die.

In the cam mechanism of the present invention, since little space is occupied, for the work having a curved surface, machining can be effected from the direction suitable to the curved surface or from the normal direction to the curved surface, so that in case of piercing or forming a circular hole, it can be finished in a true circle and not in an ellipse, improving machining quality.

Also, in the present invention, a die can be made smaller and lighter at low cost in a short period of time. Since the die is small, it is can be machined with small-sized machine tools and cranes in die machining facilities.

Moreover, in the die of the present invention, since the slide cam is slidably held and supported by the slide cam base, even when the sliding portion is worn by extended use of the die, the cam does not meander as the conventional die, but moves linearly, thus a high quality pressing work can be accomplished. Besides, since the slide cam base moves precisely in the linear direction, edges of the punch, die and cutting edge do not break. In the embodiment of the present invention, since the sliding faces of the slide cam and the driving cam are formed into the V-shaped groove, there is no possibility that the cam meanders.

Also, in the present invention, as a sliding mechanism is provided in the center portion of the cam, it can be divided into small sections, and as compared with the conventional cam in which the flanges are protected on opposite sides, the cam divided into the small sections can be held and supported at many locations, so that when compared with the conventional large member which can be held only on both sides, the cam can be held securely.

Meanwhile, when cam parts are standardized, the present invention can be applied immediately to the machining of the works having various sizes.

Though abrasion tests were run by the inventor for 300,000 times, using the die including the slide cam having the construction of the embodiment shown; the wear rate was aout (1.5 to 2.5)×1/100 mm and the wear rate of the ordinary slide cam was about 5/100 mm×⅓, showing good results.

What is claimed:

1. A die assembly comprising:

an upper displaceable die plate and an opposing lower die plate said upper and lower die plates being parallel to each other;

a workpiece support mounted on the lower die plate;

a slide cam base connected to the upper die plate, said slide cam base including a guide portion integrally formed with and angularly positioned with respect to said slide cam base;

a driving cam connected to the lower die plate, said driving cam including a guide member angularly positioned with respect to the lower die plate, wherein said guide portion and said driving cam guide member form an acute angle having an open side of the acute angle facing said workpiece support;

a slide cam slidably engaged with both said guide portion and said driving cam guide member; and means for biasing said slide cam out of alignment with said slide cam base and away from said workpiece support;

whereby displacement of said upper die plate toward said lower die plate overcomes a force applied by said means for biasing, thereby squeezing said slide cam toward said workpiece support.

2. The die assembly according to claim 1, wherein said workpiece support includes a workpiece mounted thereon and said slide cam includes a machining tool mounted thereto for engagement with the workpiece.

3. The die assembly according to claim 1, wherein said guide portion is of a tetrahedral shape and an upper surface of said slide cam is formed as a V-shaped groove member for slidably engaging with tetrahedral shape.

4. The die assembly according to claim 1, wherein said driving cam guide member has a surface mutually compatible with a lower V-shaped surface of said cam for slidably engaging therewith.

5. The die assembly according to claim 1, wherein said means for biasing is an elastic body interposed between said slide cam said slide cam base and operatively housed within the guide portion of said slide cam base.

6. A die assembly comprising:

a lower die including a lower base plate, a positioning member for supporting a workpiece, and a driving cam having a guide member formed thereon, said guide member including an upper V-shaped surface inclined with respect to the base plate and angled downward toward the positioning member;

an upper die including an upper base plate parallel to the lower base plate, and a slide cam base secured to the upper base plate, wherein a lower end of the slide cam base includes a polyhedral guide portion which is generally polyangular in cross section and provided with a crest line at a lower end thereof, the guide portion being inclined at an angle opposing the guide member of the driving cam and slanting upward with respect to the positioning member; and a slide cam slidably supporting the guide portion of the slide cam base and slidably disposed on the guide member of the driving cam, said slide cam including a machining member having a V-shaped groove member, punch and cutting edge, the V-shaped groove member being positioned by a key driven into an opposing face of the machining member, a stopper for limiting motion of the machining member, the upper end of the slide cam being formed into a V-shaped groove which has the same inclined plane as that of the polyhedral guide portion of the slide cam base for receiving the polyhedral guide portion, wear plates fixed to support lower planes of the polyhedral guide portion of the slide cam base, upper planes formed on the polyhedral guide portions of the slide cam base being urged by biasing plates fixed to the slide cam, a sliding member on the lower surface of the slide cam sliding on the guide member of the driving cam upon contacting the V-shaped groove fixed thereto, a retaining hole formed at the rear end portion of the polyhedral guide portion of the slide cam base, a support plate disposed at a position opposing the retaining hole and secured to the slide cam, and an elastic body provided between the retaining hole and the support plate.

7. The die assembly according to claim 6, wherein said elastic body is a coil spring.

* * * * *